US005498093A

United States Patent [19]

Imai

[11] Patent Number: 5,498,093

[45] Date of Patent: Mar. 12, 1996

[54] JOINT DEVICE FOR A STRUCTURAL MEMBER OF A TRUSS

[75] Inventor: Katsuhiko Imai, Ashiya, Japan

[73] Assignee: Kawatetsu Kenzai Kogyo Kabushiki Kaisha, Hyogo, Japan

[21] Appl. No.: 245,332

[22] Filed: May 18, 1994

[30] Foreign Application Priority Data

May 19, 1993 [JP] Japan ..... 5-141464

[51] Int. Cl.[6] ..... F16B 7/04; E04C 3/04

[52] U.S. Cl. ..... 403/171; 403/169; 403/176

[58] Field of Search ..... 403/171, 170, 403/169, 176, 217; 52/167.3, 81.3, 655.2, 655.1

[56] References Cited

U.S. PATENT DOCUMENTS

| | | | |
|---|---|---|---|
| 3,789,562 | 2/1974 | De Chicchis et al. | 403/171 X |
| 4,313,687 | 2/1982 | Apeztegui et al. | 403/171 |
| 4,677,804 | 7/1987 | Holt | 403/171 X |
| 4,789,264 | 12/1988 | Inchaurbe | 403/171 |
| 4,872,779 | 10/1989 | Imai | 403/171 |
| 4,915,533 | 4/1990 | de la Haye | 403/171 |
| 5,054,950 | 10/1991 | Zillgen et al. | 403/171 |
| 5,141,351 | 8/1992 | Imai | 403/171 |

FOREIGN PATENT DOCUMENTS

| | | | |
|---|---|---|---|
| 2240831 | 8/1991 | United Kingdom | 403/171 |

*Primary Examiner*—Anthony Knight
*Attorney, Agent, or Firm*—Jordan and Hamburg

[57] ABSTRACT

A joint device has a fastening bolt provided with a first external threaded part to engage a screw hole of a node, a polygonal boss slidably engaged with a sleeve, a third external threaded part and a second reversely threaded part engaged with an anchor nut in a steel pipe. The third part engages with an internal threaded part on the inner face of a bore in an end cap welded on the end of the steel pipe so that the first part can be advanced to the node or retracted into the sleeve. The sleeve has a stopper on the corners of the polygonal hole thereof so that it is prevented from coming off the fastening bolt. The device enables a connection of a steel pipe and a node even where the pipe is inclined or perpendicular to the ground.

18 Claims, 10 Drawing Sheets

JOINT DEVICE FOR A STRUCTURAL MEMBER OF A TRUSS

BACKGROUND OF THE DISCLOSURE

The present invention relates to a joint device for correcting a structural member in a space truss structure and, more particularly, to a device capable of easily and tightly connecting a plurality of long steel pipes to nodes in the space truss structure.

In a space truss structure each steel pipe is joined at a node by a fastening bolt mounted in an end cap closing the respective pipe. The fastening bolt is axially slidable in a sleeve disposed between a spherical node and the end cap, provided with a first external threaded part engaging a screw hole in the node, a second external threaded part engaging an anchor nut in the steel structural pipe and a polygonal boss formed on an intermediate portion thereof. Rotation of the sleeve, slidably engaged with the polygonal boss, joins the steel pipe to the node.

A sufficient protrusion of the first external threaded part beyond an end of the sleeve is required to engage the first threaded part with the screw hole of the node, e.g., one or two threads, substantially 3 to 5 mm. Upon completion of assembly of most portions of the truss, positions of nodes to which a final structural pipe member is to be joined are established. Thus, the protrusion of the first threaded part hinders fitting the final structural pipe member into the space between the nodes, since the distance therebetween has already been defined.

U.S. Pat. No. 4,872,779 discloses a joint device for fitting a steel pipe between unmovable nodes by temporarily retracting a fastening bolt back into a sleeve. The device is provided with a coiled spring, compressed when an end of a threaded part of the fastening bolt contacts the node, which biases the fastening bolt toward a screw hole in the node the distance necessary for an initial engagement of the two parts.

Since the joint device is equipped with a coiled spring and a sleeve nut to mount the fastening bolt in addition to a fastening bolt and a sleeve, the number of parts and the amount of thread cutting increase. Also, accommodation of a coiled spring in the sleeve requires the device be longer and/or larger.

A device without a coiled spring is disclosed in U.S. Pat. No. 5,141,351. A fastening bolt has an outside thread formed on each of a plurality of longitudinal edges of a polygonal boss which engage an internal thread formed on an inner face of a bore in an end cap, the pitch of which is identical to that of a first threaded part of the fastening bolt.

Reverse rotation of the sleeve put on the boss partially engaging the internal thread permits an end of the fastening bolt to be retracted into the sleeve. Positively rotating the sleeve advances the fastening bolt to the node by engagement of the outside thread with the internal thread, permitting the end of the first threaded part to enter a screw hole of the node.

A diameter of the internal thread in the end cap is increased because of the engagement with the outside thread of the polygonal boss, thus increasing the amount of thread cutting and decreasing the strength of the end cap. Adding thickness to the end cap for strengthening results in an increase in weight.

The above device has a bolt head instead of an anchor nut as used in the device of U.S. Pat. No. 4,872,779 to maintain the end of the fastening bolt inside the end cap. A fastening bolt provided with a bolt head is applicable to a joint device for heavy loads since it has no second threaded part which is substantially smaller than the shank of a fastening bolt. However, use of a bolt head requires thick material for manufacturing a fastening bolt with a large bolt head. As a result, the amount of machining increases as do expenses.

The sleeve and the fastening bolt are shipped to a construction site after they are integrated with steel pipes in the manufactory. Although the sleeve is put on the fastening bolt, it is slidable along the polygonal boss thereof and is not locked on the end of a steel pipe. The structural pipes are intentionally or unintentionally inclined during transportation to desired nodes by lifting machinery. Thus, construction of a truss is interrupted if the sleeves fall off the fastening bolts.

To solve the problem, each sleeve is temporarily fixed to the respective steel pipe by adhesive tapes etc. prior to transport to the site or hoisting to the constructing space. It is inconvenient for workers to remove the tape just before the rotation of the sleeve for connecting the steel pipe to the node.

SUMMARY OF THE INVENTION

An object of the invention is to provide a device for joining structural pipe members in a space truss structure by using a fastening bolt engaging a connector node.

Other objects are to reduce the number of parts of a joint device, to decrease the amount of machining required to manufacture a fastening bolt, to supply inexpensive fastening bolts of superior durability and to prevent a sleeve from coming off a fastening bolt, thereby, permitting the structural pipe members to be smoothly connected to the nodes.

The invention provides to a device, for joining or connecting a structural member to a connector node, having a fastening bolt provided with an external threaded part engaging a screw hole of the node and a polygonal boss slidably engaged in a hole of a sleeve disposed between the structural member and the node.

The present invention includes a sleeve having a stopper fixed on an inner face of a hole therein to prevent the sleeve from falling off a fastening bolt by contacting with a peripheral portion of the polygonal boss furthest from the node. The distance from the end face on the node side of the sleeve until the stopper is more than a length from an end of the external threaded part of the fastening bolt to an end face of the polygonal boss.

Another feature includes a device having a fastening bolt with a second external threaded part, whose screw spiral is opposite to that of a first external threaded part engaging a screw hole of a node, to engage with an anchor nut in the structural member, comprising: a fastening bolt having a third external threaded part, with identical spiral and pitch as those of the first external threaded part, formed between the polygonal boss and the second external threaded part, having a major diameter larger than that of the second external threaded part and smaller than a diameter of an inscribed circle of a polygonal hole of the sleeve. An end cap closing an end face of the structural member is provided with an internal threaded part formed on an inner face of a center bore therein, engaging the third external threaded part. A protrusion of a stopper contacting the peripheral portion of the polygonal boss furthest from the node permits the third external threaded part to pass through the hole in the sleeve. Consequently, a steel structural pipe is tightly connected to a node by rotating the sleeve engaged with the polygonal boss of the fastening bolt and the stopper prevents the sleeve from coming off the bolt allowing construction of a space truss to be smoothly performed.

An engagement of the third external threaded part on the bolt with the internal threaded part in the end cap allows extension of the first threaded part from the end of the sleeve for an initial engagement of the first threaded part with the screw hole of the node. This allows a steel pipe to be fitted into or be removed from a space between unmovable nodes fixed on the completion of assembly of most portions of a truss.

DETAILED DESCRIPTION OF THE INVENTION

Figure 1:
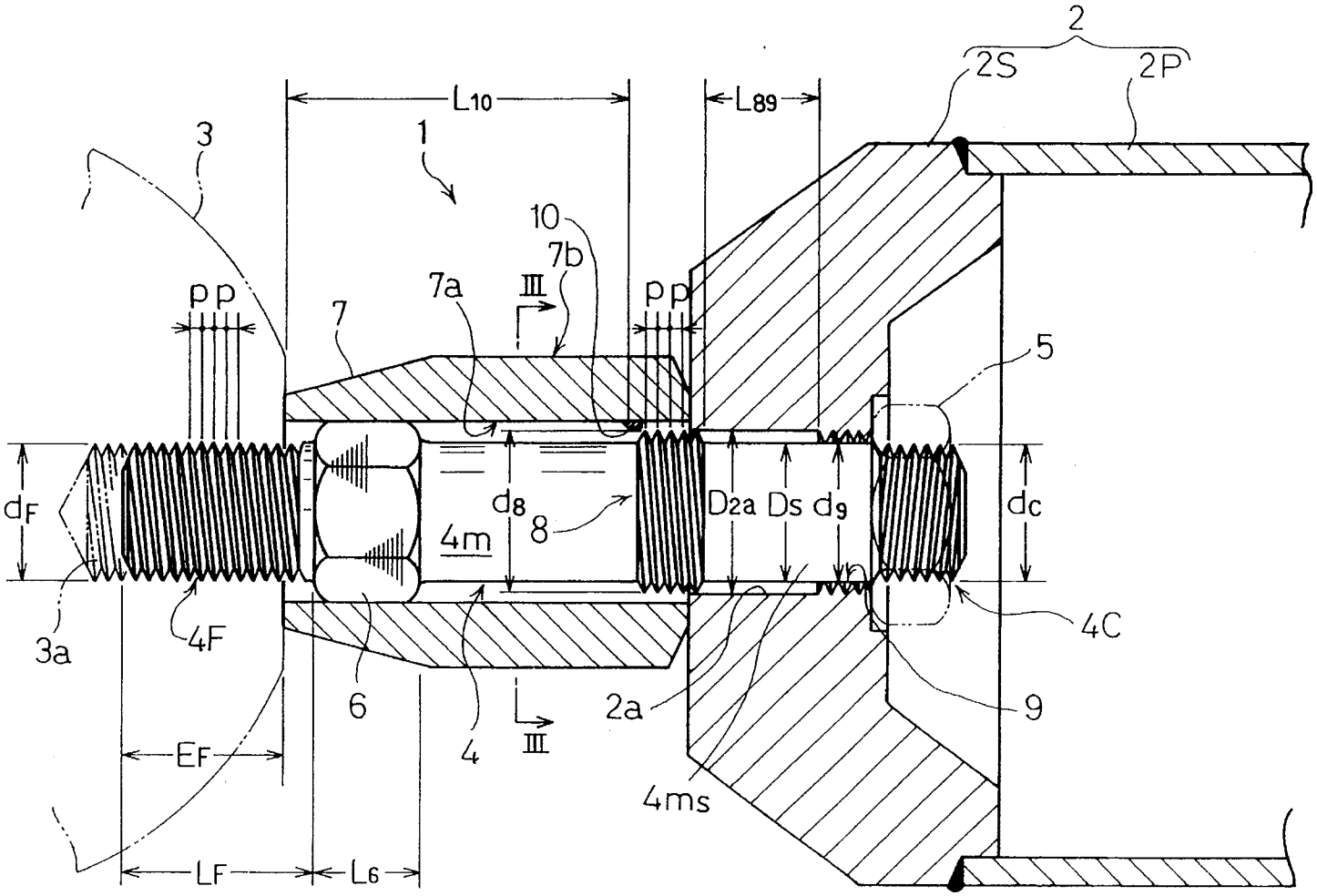
FIG. 1 is a sectional view of the joint device of the present invention installed on the end of the structural member.

FIG. 1 is a sectional view of a joint device 1 joining one structural member 2 to a connector node 3. The structural member 2 is composed of a long steel pipe 2P and an end cap 2S welded on an end thereof. The end cap 2S has a bore **2*a* in the center thereof to mount a fastening bolt 4 joining the structural member 2 to the node 3**.

The fastening bolt 4 has a first external threaded part 4F engaging a screw hole 3a of the node 3, a second external threaded part 4C engaging an anchor nut 5 in the steel pipe 2P and a polygonal boss 6 formed between the threaded parts 4F and 4C. The first threaded part 4F is a right-handed screw and the second 4C is a left-handed one.

Since the screw spiral of the second threaded part 4C is opposite that of the first threaded part 4F, a rotation of the first threaded part 4F to engage the screw hole **3*a* of node 3 tightens an engagement of the second threaded part 4C with the anchor nut 5 in the steel pipe 2**.

The polygonal boss 6 is formed on the intermediate portion of a shank **4*m* of the bolt 4. Since the sectional shape of boss 6 is, e.g., hexagonal similar to that of a hole 7*a* of a sleeve 7, the boss 6 and sleeve 7 slidably engage each other, and a rotation of sleeve 7 rotates and advances the fastening bolt 4 for engagement with the node 3. The sleeve 7 has a torque transmitting portion 7*b***, consisting of six outside surfaces, for engagement with a wrench or similar device.

A third external threaded part 8, having a screw spiral and screw pitch the same as those of the first external threaded part 4F, is formed between the polygonal boss 6 and the second threaded part 4C. A major diameter $d_8$ of the external threaded part 8 is larger than a major diameter $d_c$ of the second part 4C and smaller than a diameter of an inscribed circle of the hexagonal hole **7*a* of sleeve 7 so that the part 8 can pass through the hole 7*a*. An internal threaded part 9, engaging the third threaded part 8, is formed on an inner face of the bore 2*a* in the end cap 2S and has a minor diameter larger than a major diameter of the second threaded part 4C**.

Figure 5:
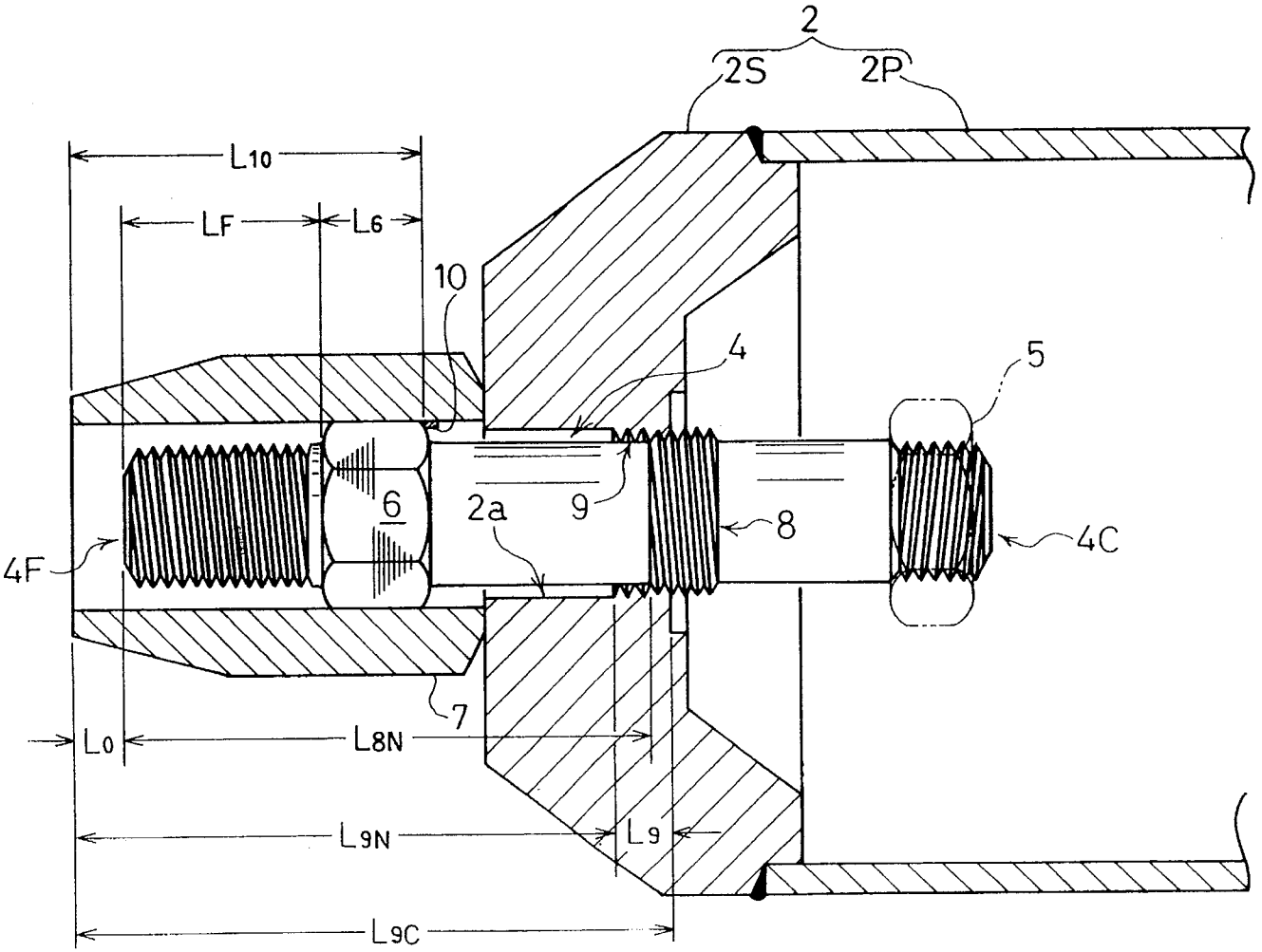
FIG. 5 is a sectional view of the joint device, the fastening bolt of which is retracted until the polygonal boss contacts the stopper in the sleeve.

The sleeve 7 is provided with a stopper 10 on the inner face of the hole therein so that the contact of the stopper 10 with a peripheral portion on a counter-node side of the boss 6 prevents the sleeve 7 from coming off the fastening bolt 4 toward the node 3. As shown in FIG. 5, the distance $L_{10}$ between the stopper 10 and the end face on the node side of the sleeve 7 is selected to be more than the length $L_F+L_6$ obtained by adding together the length $L_F$ of the first threaded part 4F and the width $L_6$ of the polygonal boss 6.

Figure 2:
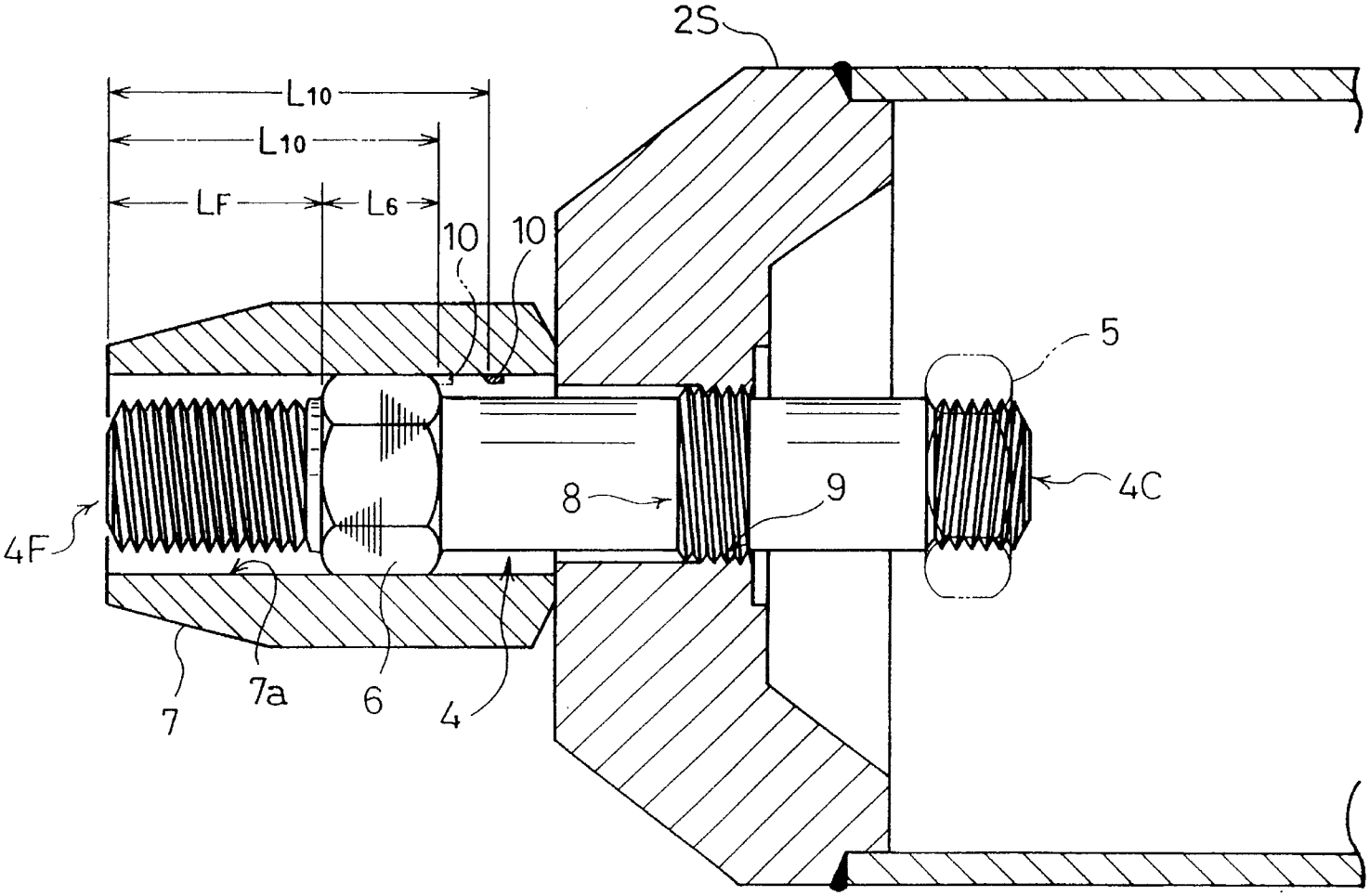
FIG. 2 is a sectional view of the joint device, the first external threaded part of which is retracted into the sleeve.

Referring to FIG. 2, the stopper 10 is drawn by a double dotted chain line in a position away from the end face of the sleeve 7 identical to the length from the end of the first threaded part 4F to the end on the counter-node side of the boss 6. The stopper 10 shown drawn by a solid line is positioned deeper than the former. Either stopper location is permissible.

The stopper 10 may be formed by using small beads welded, metallic pieces bonded or the like on the corner of a hexagonal hole **7*a* in the sleeve 7. The protrusion of the stopper 10 should be selected not only large enough to stop the polygonal boss 6 from falling off but small enough to pass over the third threaded part 8**.

Figure 3:
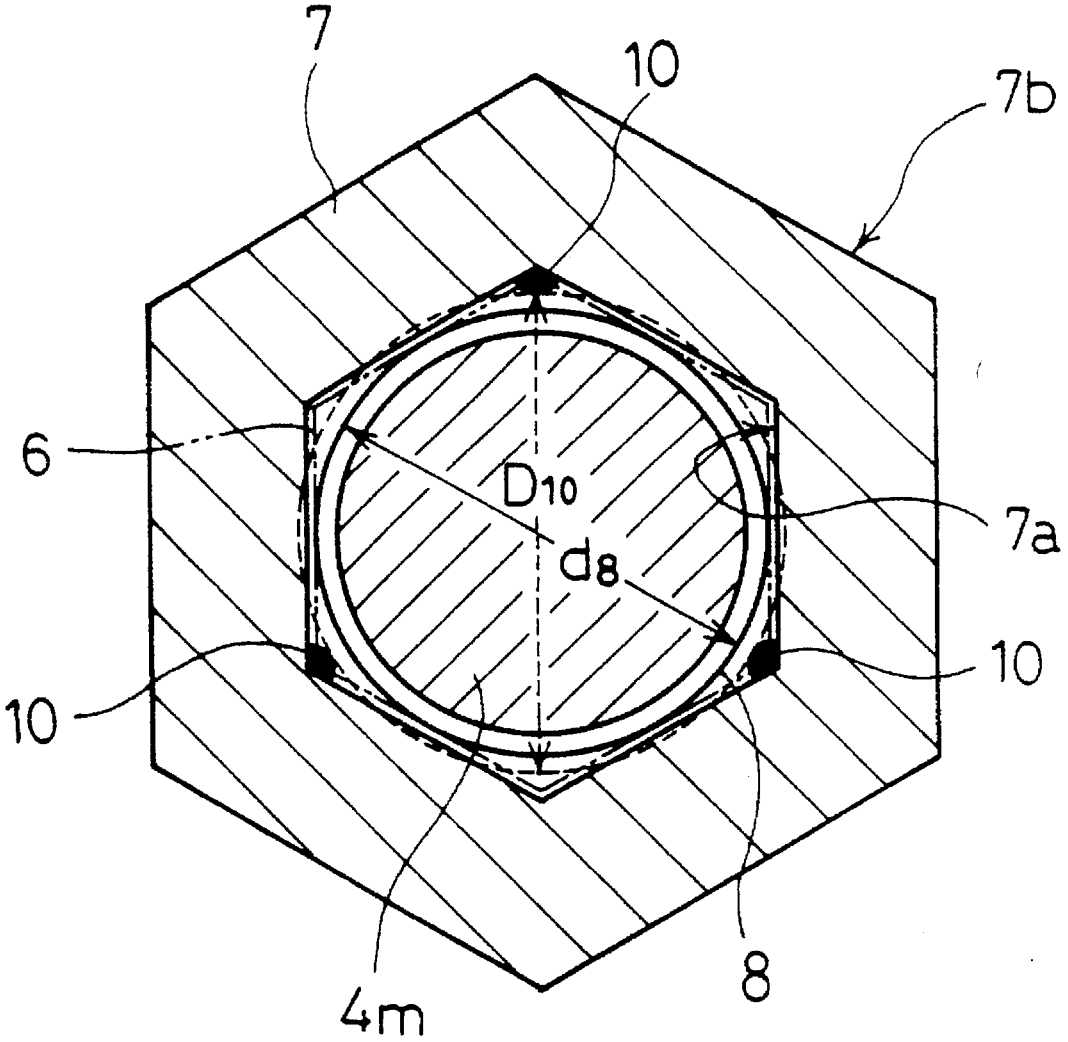
FIG. 3 is a view taken along the line III—III of FIG. 1.

Referring to FIG. 3, an example is shown with three welded beads every two corners. It is clear that a diameter $D_{10}$ of an inscribed circle of welded beads 10 is larger than a major diameter $d_8$ of the third external threaded part 8 as discussed above. The diameter $d_8$ of the third threaded part 8 is selected, as shown in FIG. 1, to be larger than or equal to a major diameter $d_F$ of the first threaded part 4F, as long as the screw spiral and pitch are equivalent to each other. Referring again to FIG. 1, since the spiral of the second external threaded part 4C is opposite to that of the third threaded part 8, the major diameter $d_c$ of the second threaded part 4C is selected to be smaller than minor diameter $d_9$ of the internal threaded part 9.

Referring to FIG. 2, although the third external threaded part 8 does not always engage the internal threaded part 9 in the end cap 2S, it is, however, required because the fastening bolt 4 should be movable at least the distance $E_F$ (FIG. 1) from a state of FIG. 2, the first threaded part 4F being retracted in the sleeve 7, to a state of FIG. 1 wherein the first threaded part 4F is perfectly engaged with the screw hole **3*a* of node 3**.

The third external threaded part 8 is preferably engaged with the internal threaded part 9 when the fastening bolt 4 commences to advance from the retracted position in response to a rotation of sleeve 7. Therefore, as best seen in FIG. 1, the length $L_{89}$, from the counter-node side of the third threaded part 8 to the node side of the internal threaded part 9, is preferably shorter than the length $E_F$ for a full engagement of the first threaded part 4F with the screw hole **3*a* of the node 3** to be achieved.

In operation, the third threaded part 8 does not necessarily engage the internal threaded part 9 when the first threaded part 4F fully engages the screw hole 3*a* of the node 3 as in FIG. 1. However, as shown in FIG. 2, the third threaded part 8 is preferably engaged with the internal threaded part 9 when the end of the first threaded part 4F coincides with the end on the node side of the sleeve 7. In addition and as shown in FIG. 5, the engagement of the part 8 with the part 9 is preferably maintained when the boss 6 contacts the stopper 10 where the stopper 10 is provided more deeply than $L_F+L_6$.

Figure 4:
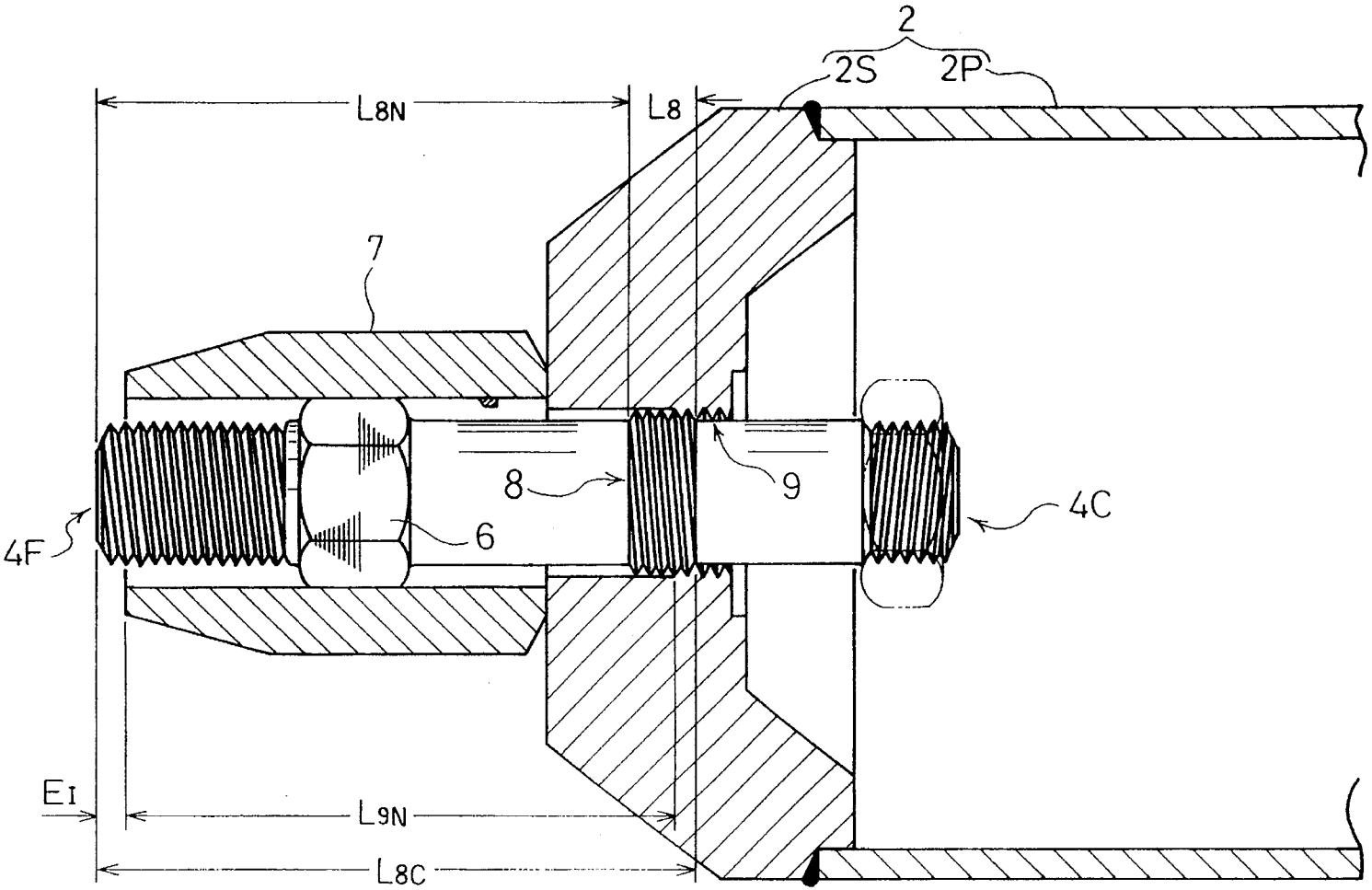
FIG. 4 is a sectional view of the joint device, the first threaded part of which protrudes from the sleeve for initial engagement with the screw hole of the node.

Furthermore, as shown in FIG. 4, the third threaded part 8 is preferably still engaged with the internal threaded part 9 when the length $E_I$ of the first part 4F protrudes from the opening of the hole 7*a* in the sleeve 7 to engage the node 3. The extension of length $E_I$ is effected by advancing the first threaded part 4F retracted in the sleeve 7.

Referring to FIG. 4, a relative position between the third threaded part 8 of the fastening bolt 4 and the internal threaded part 9 of the end cap 2S is shown. The length $L_{9N}$, from the end face on the node side of sleeve 7 to the end on the node side of the internal threaded part 9, in a state where the sleeve 7 contacts the end cap 2S, is preferably selected to be shorter than the difference $L_{8c}-E_I$ between the length $L_{8c}$, from the end on the node side of the first threaded part 4F to the end on the counter-node side of the third threaded part 8, and the length $E_I$ for initial engagement of the first part 4F with the hole 3*a* of the node 3.

Referring to FIG. 5, a length $L_{9c}$ from the end face of the node side of sleeve 7, in contact with the end cap 2S, to the end on the counter-node side of the internal threaded part 9 is preferably selected to be longer than the length $L_o+L_{8N}$ obtained by adding the length $L_o$, from the end on the node side of the sleeve 7 to the end on the node side of the first threaded part 4F, to the length $L_{8N}$ from the end on the node side of the first threaded part 4F to the end on the node side of the third threaded part 8 when the polygonal boss 6 contacts with the stopper 10.

The length $L_8$ of the third threaded part 8 in FIG. 4 and the length $L_9$ of the internal threaded part 9 in FIG. 5 are treated in the following dimension relationships. By observation $L_{9N}<L_{8c}-E_I$, as seen in FIG. 4, yields $L_{9N}<L_{8N}+L_8-E_I$, and $L_{9c}>L_o+L_{8N}$, as in FIG. 5, yields $L_{9N}+L_9>L_o+L_{8N}$. Consequently, $L_o+L_{8N}-L_9<L_{9N}<L_{8N}+L_8-E_I$ and $L_o-L_9<L_8-E_I$ are obtained.

The stopper 10 should be positioned more deeply than $L_F+L_6$ as seen in FIG. 2 and the example of FIG. 5 gives $L_{10}=L_o+L_F+L_6$. The length $L_o$, from the end on the node side of the sleeve 7 to the end on the node side of the first threaded part 4F, is shorter than $L_8+L_9-E_I$ when the boss 6 contacts the stopper 10.

Figure 6:
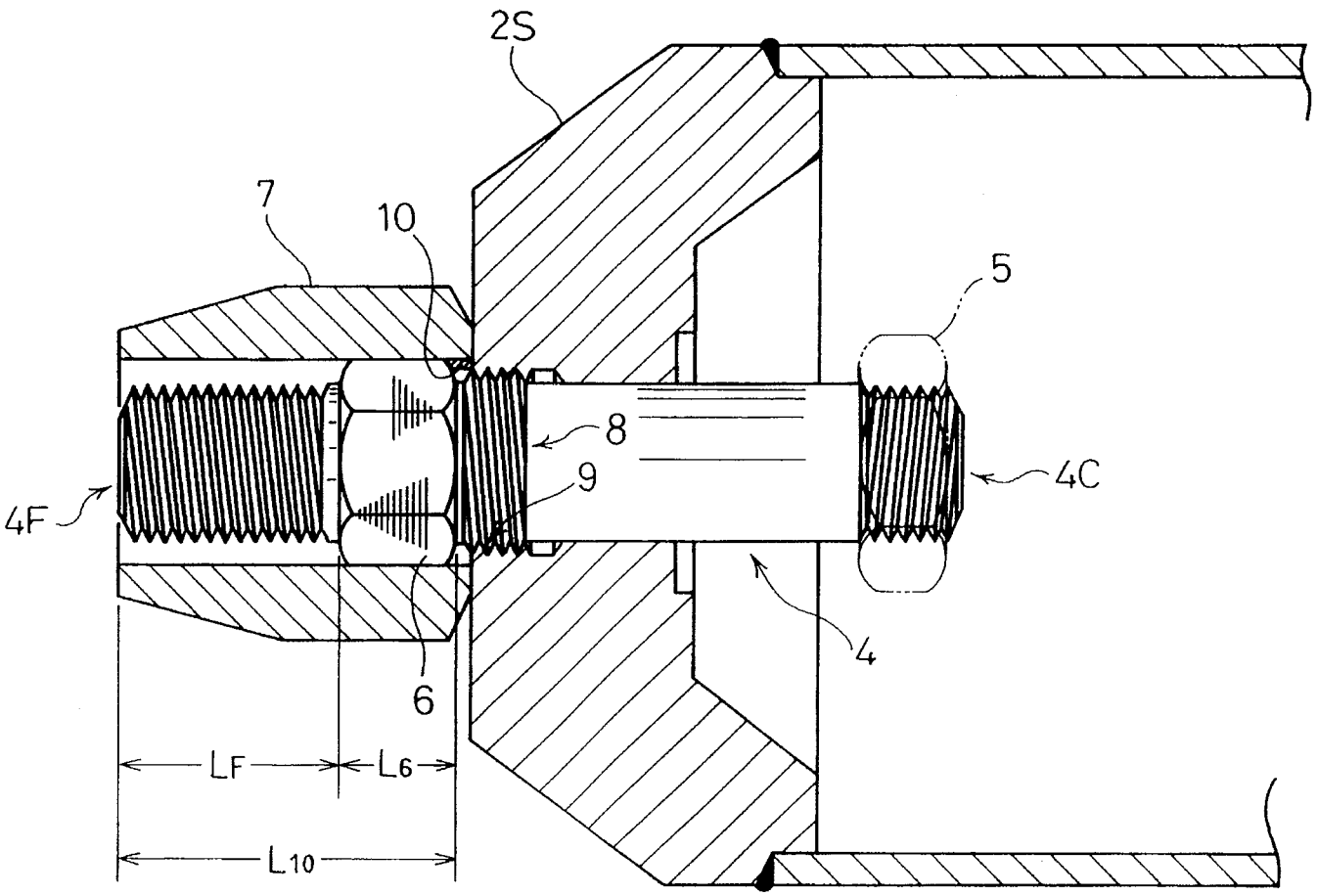
FIG. 6 is a sectional view of the joint device, the third part of which is provided closely to the boss.
Figure 7:
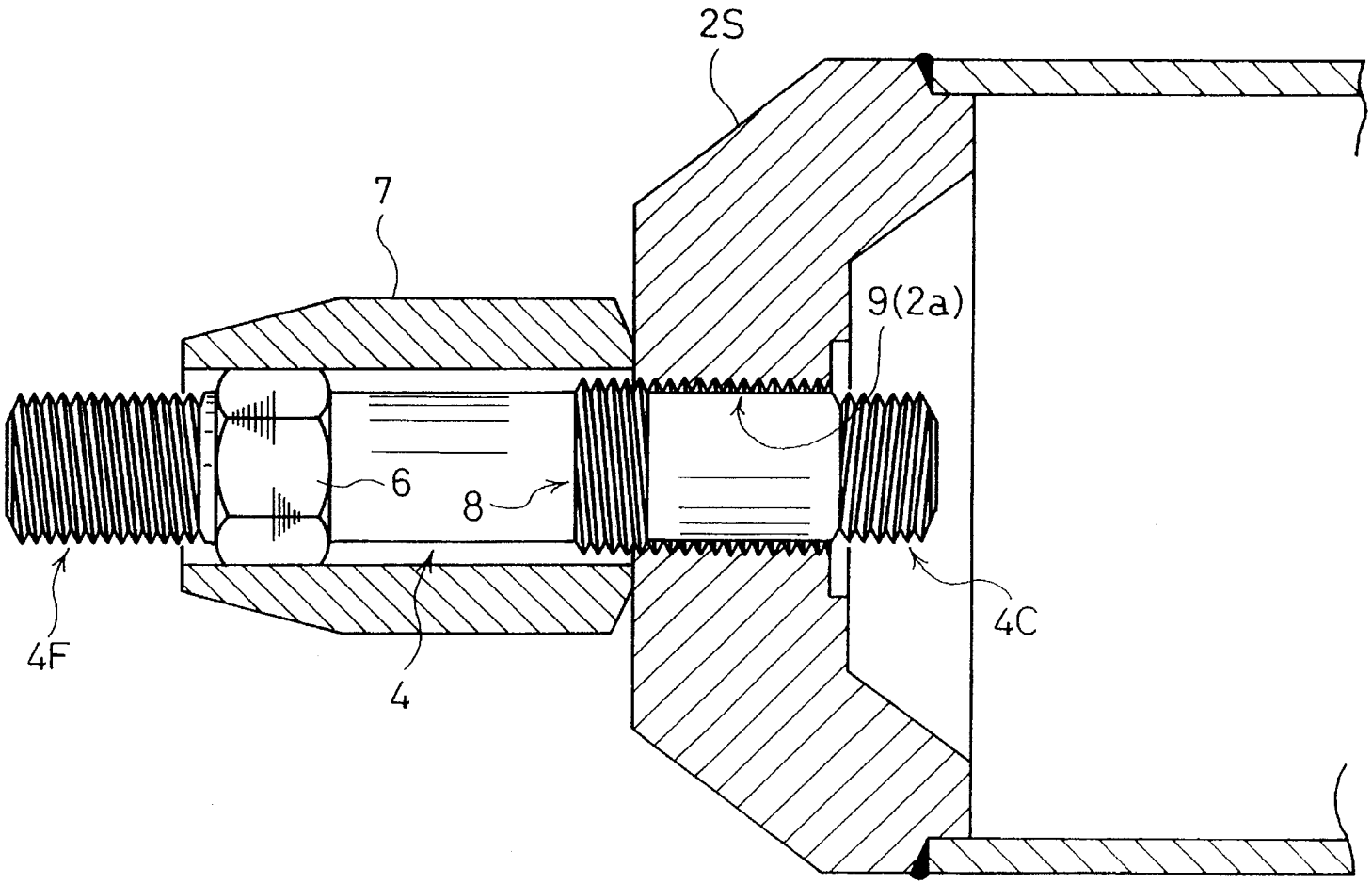
FIG. 7 is a sectional view of the joint device, the internal threaded part of which is formed on the entire inner face of the bore in the end cap.

When the stopper 10 is at the position indicated by a double dotted chain line, as shown in FIG. 2, $L_o=0$. According to the above formulas, it is possible to reduce the length $L_8$ of the third threaded part 8 and the length $L_9$ of the internal threaded part 9 though they are not so depicted. If the third threaded part 8 is proximate to the polygonal boss 6, as shown in FIG. 6, a fastening bolt 4 can be shortened. The internal threaded part 9 may be formed on the whole inner face of the bore 2*a* of end cap 2S as seen in FIG. 7, if required.

Referring to FIG. 1, the third threaded part 8 need not engage the internal threaded part 9 when the first threaded part 4F completely engages the screw hole 3*a* of node 3, i.e., when the length Ef is protruded from the sleeve 7 as shown. A straight axial movement of the fastening bolt 4 toward the internal threaded part 9 is preferred so that the polygonal boss 6 in the sleeve 7 maintains the attitude of the fastening bolt 4 when a structural member 2 is removed from a node 3.

The diameter $D_{2a}$ of the bore 2*a* in the end cap 2S is preferably a little larger than the diameter $d_8$ of the third threaded part 8 if a fastening bolt 4 is so long, so the third part 8 can be guided by the bore 2*a* and the bolt 4 can be smoothly retracted into sleeve 7. The diameter $D_S$ of shank $4m_s$ between the second part 4C and the third part 8 may be also slightly smaller than a diameter $d_9$ of an internal threaded part 9 in the end cap 2S so the shank $4m_s$ can be guided by the threaded part 9 and the bolt 4 can be easily retracted into the sleeve 7.

Figure 8:
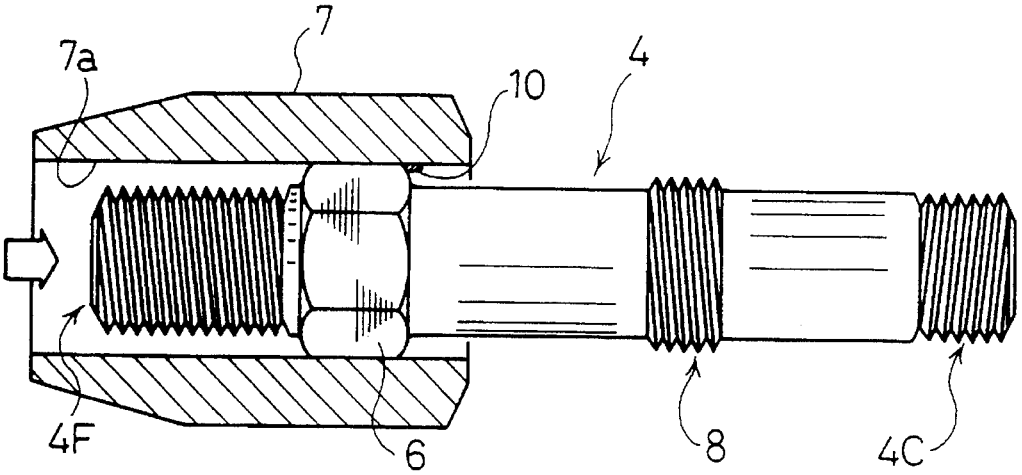
FIG. 8 is a sectional view of the fastening bolt inserted into the sleeve.
Figure 9:
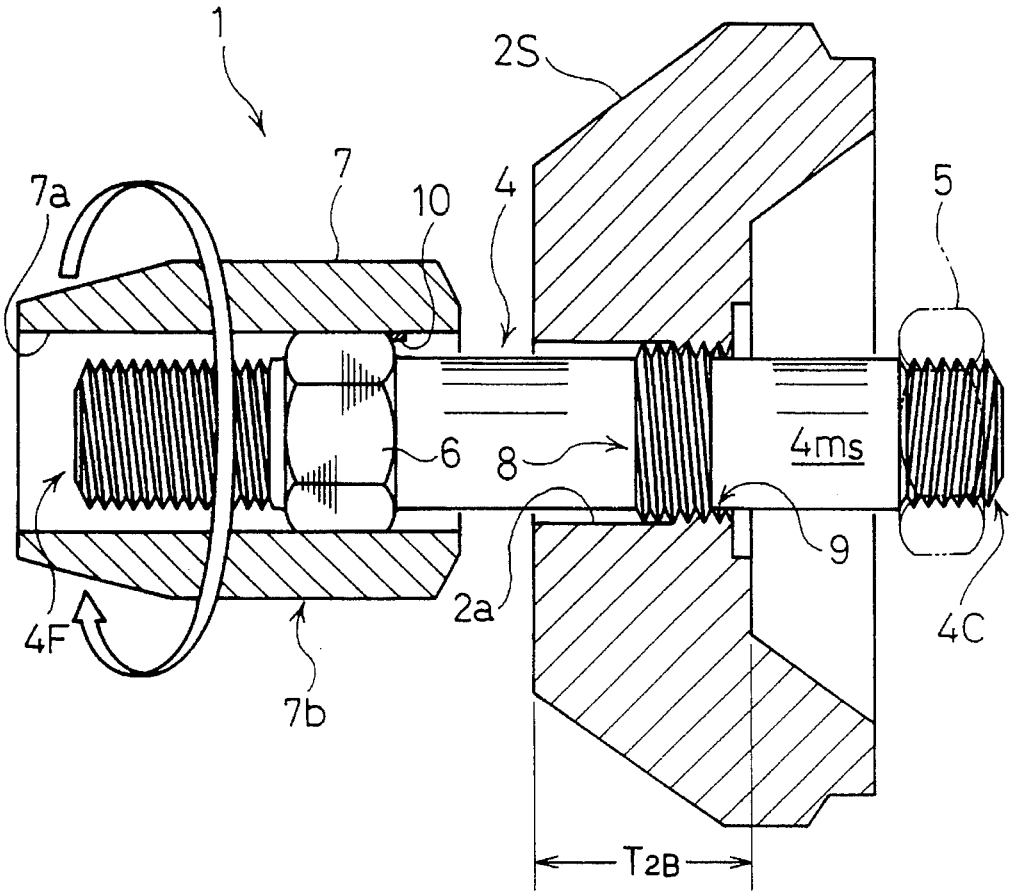
FIG. 9 is a sectional view in the state in which the fastening bolt is installed on the end cap.
Figure 10:
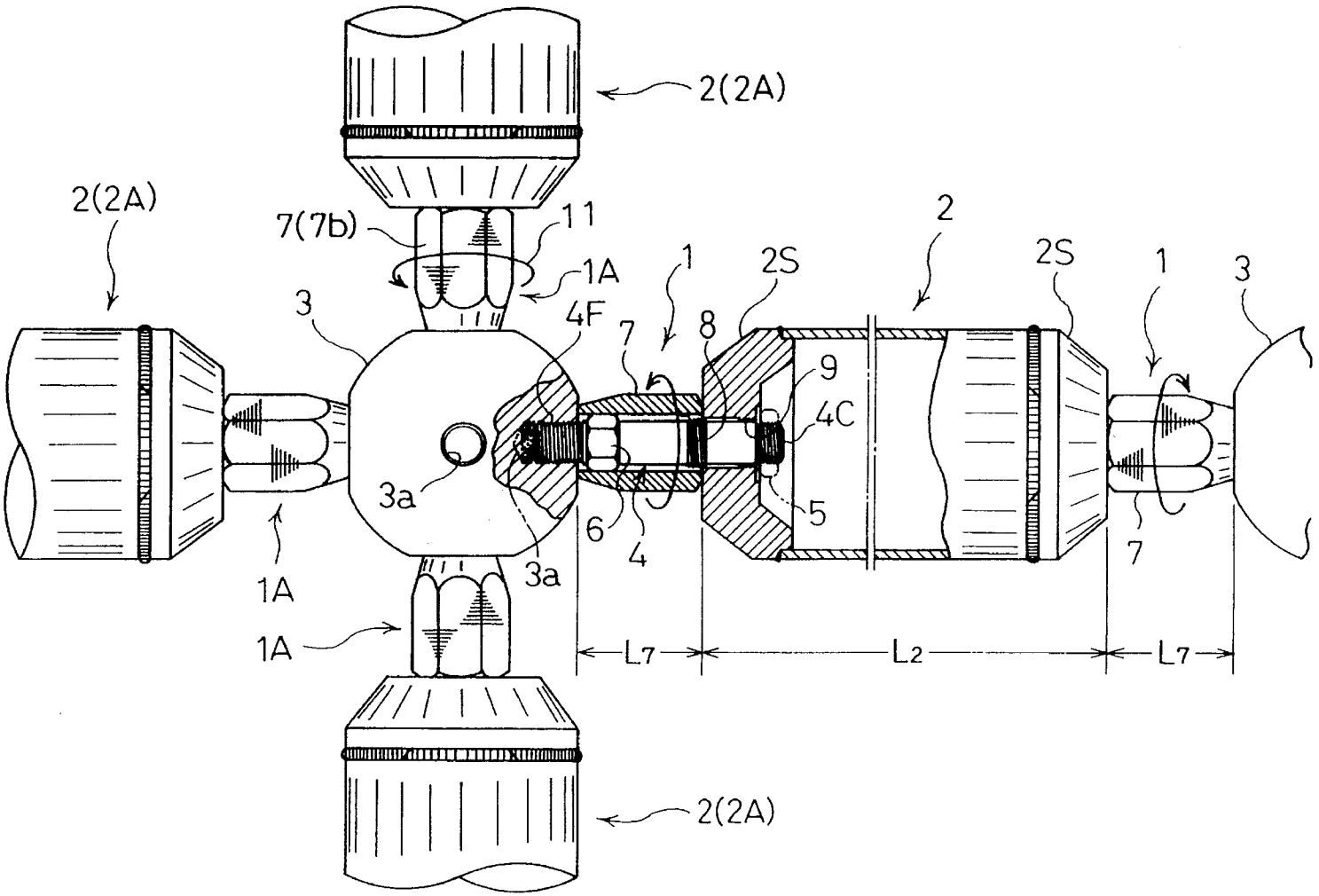
FIG. 10 is a sectional view illustrating the connection operation.

Referring to FIGS. 8–10, the joining of the structural pipes 2 to the nodes 3 by the fastening bolts 4 into a space truss by joint devices 1 is shown. The second threaded part 4C of the fastening bolt 4 is inserted into an opening on the node side of the sleeve 7 until the peripheral portion on the counter-node side of boss 6 contacts with a stopper 10. The sleeve 7 is rotated, as shown in FIG. 9, to engage third threaded part 8, protruding from the sleeve 7, with the internal threaded part 9 in the end cap 2S. The anchor nut 5 is completely engaged with the threaded part 4C protruding at the opposite side of the end cap 2S to complete assembly of the joint device 1 and the end cap 2S. Each end cap 2S is welded to an end of steel pipe 2P as shown in FIG. 1. The sleeve 7 is maintained on the fastening bolt 4 by the contact of the boss 6 with the stopper 10 as shown in FIG. 9 even when the steel structural pipe 2 is inclined during transportation.

Since the fastening bolt 4 is provided with a swell boss 6, but is not provided with a bolt head, it can be inexpensively manufactured because of a reduced amount of machining. Where a thick fastening bolt 4 is applied to a steel pipe 2, carrying a heavy axial load, a diameter of the bore 2*a* in the end cap 2S is only large enough to pass through the second threaded part 4C and the shank $4m_s$. Consequently, reduction of sectional material of the end cap 2S is little and thickness $T_{2B}$ thereof can be thin in order to lighten a structural member 2. Nevertheless, since the size of the anchor nut 5 is larger than that of the boss 6, the nut 5 is easily and inexpensively manufactured individually.

The structural pipe 2 with joint device 1 is transported to nodes in a truss structure by a crane so that the end of the first threaded part 4C faces the opening of the screw hole 3*a* of node 3. Positive rotation of sleeve 7 toward the node 3, as indicated by arrow 11 in FIG. 10, rotates the polygonal boss 6 and rotates and advances the fastening bolt 4 to engage the first threaded part 4F with the screw hole 3*a* of node 3. The positive rotation of the fastening bolt 4 effects a tight engagement of the anchor nut 5 with the second threaded part 4C having a reverse thread.

Figure 11:
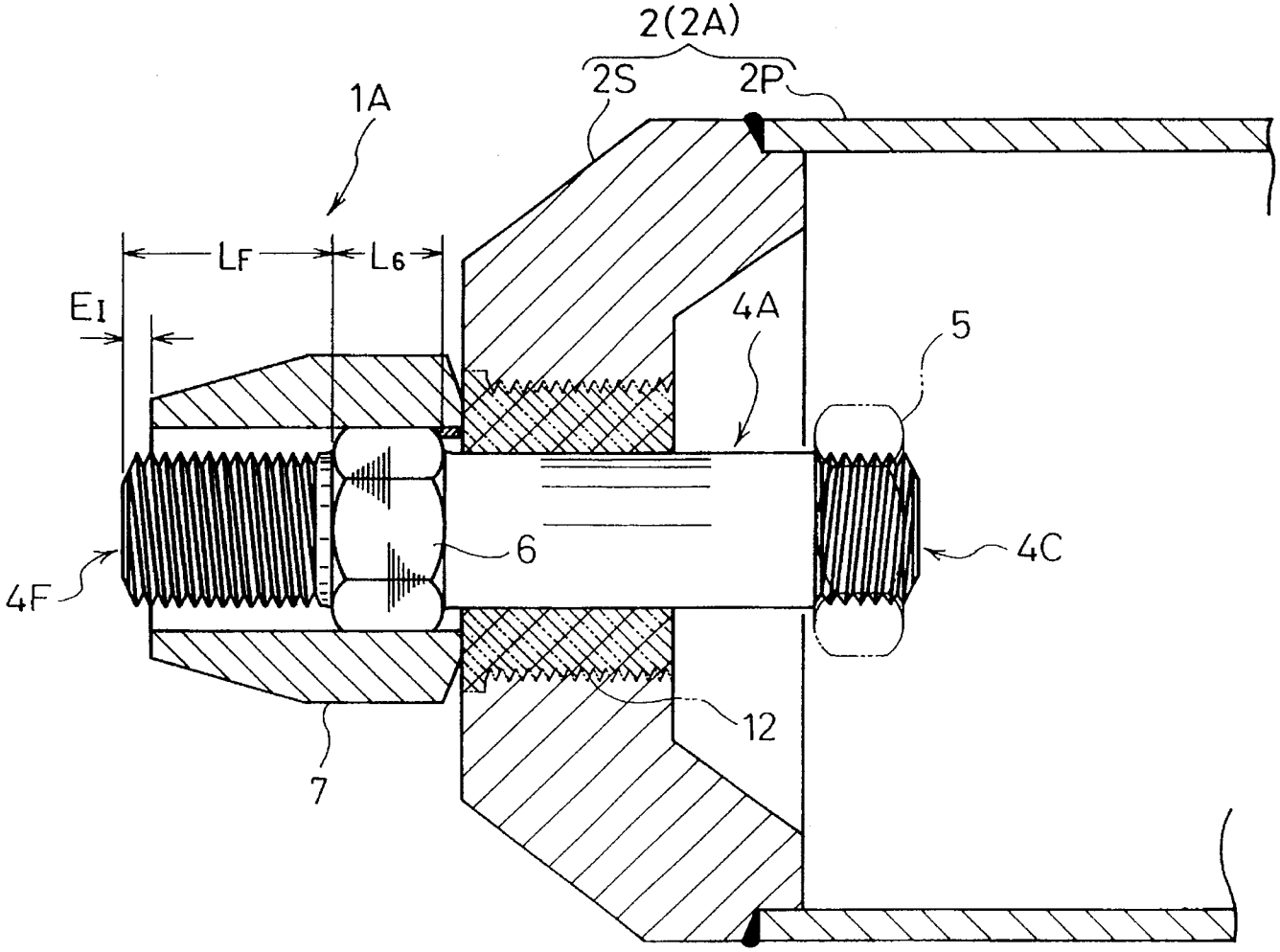
FIG. 11 is a sectional view of the joint device, the fastening bolt of which is not provided with the third external threaded part.

Referring to FIG. 11, where the nodes 3 are movable and a distance therebetween is not fixed, a joint device 1A is applied because a protrusion $E_I$, for initial engagement of the first threaded part 4F with the screw hole 3*a*, is acceptable during connecting work. Such a fastening bolt A is not provided with the third threaded part 8, shown in FIG. 1, therefore, the stopper is disposed at the depth of $L_F+L_6-E_I$, and an internal threaded part 9 in the end cap 2S is unnecessary.

Upon completion of assembly of most portions of the truss, the distance between nodes 3 to which the final structural member is to be joined is fixed and equal to the length obtained by adding the length $L_2$ of steel pipe 2 to twice the length $L_7$ of sleeve 7. Referring again to FIG. 4, the protrusion $E_1$ for the initial engagement interferes with fitting the structural member 2 between the nodes 3 and 3.

Reverse rotation of the sleeve 7 advances the fastening bolt 4 toward the end cap 2S. The engagement of the third threaded part 8 with the internal threaded part 9 is maintained even when the boss 6 contacts the stopper 10. Elimination of the protrusion of the first threaded part 4F from the sleeve 7 allows the structural member 2 to be inserted into the space between unmovable nodes 3 and 3.

Positive rotation of the sleeve 7 after the end face thereof meets the screw hole **3*a* of node 3 advances the third threaded part 8 by engaging the internal threaded part 9 until the protrusion $E_I$ for the initial engagement from the sleeve 7 is achieved as shown in FIG. 4. Continuing positive rotation of the sleeve 7 engages the first threaded part 4F with the screw hole 3*a* of node 3. Even though the third threaded part 8 is still engaged with the internal threaded part 9, the threaded part 8 can advance in correspondence with the threaded part 4F because each have the same spiral and screw pitch "p". After engagement of the part 8 with the part 9 is released, the fastening bolt 4 is advanced toward the node 3 by engagement with the screw hole 3*a*. The advance of the fastening bolt 4 toward the node 3 is permitted because the diameter $d_8$ of the third part 8 is small enough to pass through the polygonal hole 7*a* of sleeve 7 and the protrusion of the stopper 10 does not hinder movement of the third threaded part 8**.

The first threaded part 4F stops advancing when each end of the sleeve 7 contacts the node 3 and the end cap 2S by a full engagement $E_F$ of the first threaded part 4F with the screw hole **3*a* of the node 3. Upon final tightening of the sleeve 7, a firm connection between the structural member 2 and the node 3 is achieved. A compressive force acting between the nodes 3 is transmitted to a steel pipe 2 through the sleeve 7. The fastening bolt 4 withstands an axial tension action on the steel pipe 2P**.

The sleeve 7 is rotated in reverse when a steel pipe is removed from nodes 3, for instance, to correct an assembling error. The reduction of engagement of the first threaded part 4F with the screw hole **3*a* by reverse rotation of the bolt 4 effects engagement of the third threaded part 8 with the internal threaded part 9. Further reverse rotation of the sleeve 7 retracts the end of the first part 4F into the sleeve 7 allowing removal of the structural member 2 from nodes 3**.

The fastening bolt 4 is maintained in the center of the bore **2*a* of the end cap 2S, if a diameter $D_S$ of the shank $4m_S$ is selected to be almost equal to the minor diameter $d_9$ of the internal threaded part 9, thereby permitting reengagement of the third threaded part 8 with the internal threaded part 9 to be smoothly performed due to the maintenance of a previous attitude of the fastening bolt 4. Additionally, in the case that a diameter $D_{2a}$ of the bore 2*a* is selected to be almost equal to the major diameter $d_8$ of the third threaded part 8**, the above reengagement is identically achieved.

It is realized that the stopper 10 is also applicable to other joint devices, i.e., a sleeve 7 never comes off a fastening bolt not only in the device 1 of FIG. 1 but also in the device 1A of FIG. 11 without a third threaded part.

In the device of FIG. 11, the end cap 2S is welded to a steel pipe 2P after a second threaded part 4C is engaged with an anchor nut 5 similar to FIG. 9. If the end cap 2S is provided with a sleeve nut 12 shown, a fastening bolt 4A previously inserted into a sleeve nut 12 can be installed on the end cap 2S already welded to a steel pipe 2P as described in U.S. Pat. No. 4,872,779.

The present invention permits secure fastening of a structural member to a node by using a polygonal sleeve and prevents the sleeve from coming off a fastening bolt by means of a stopper allowing construction of a space truss to be rapidly and smoothly performed.

The engagement of the third external threaded part with the internal threaded part enables advancement of the fastening bolt and retraction into the sleeve, even though a steel pipe is inclined and/or perpendicular to the ground, so that a structural member can be fitted into and be removed from the space between nodes already defined.

What is claimed is:

1. A joint device for joining or connecting a structural member to a connector node having a screw hole comprising:

a fastening bolt with an external threaded portion at a first end thereof for engaging the screw hole of the node and a second end, opposite said first end, for communicating with said structural member;

a sleeve having first and second end faces at opposite ends thereof for engaging said node and said structural member, respectively, and said sleeve defining a sleeve hole;

said fastening bolt having a polygonal boss disposed between said external threaded portion and said second end;

said fastening bolt slidably engaging said sleeve hole of said sleeve with said polygonal boss, said fastening bolt having an orientation having said first end nearest said first end face of said sleeve and said second end nearest said second end face of said sleeve;

a stopper, disposed on an inner face of said sleeve hole in said sleeve, sufficient in size to contact a peripheral portion of said polygonal boss closest to said second end and prevent sliding movement of said polygonal boss of said fastening bolt past said stopper and thereby prevent complete passage of said sleeve over said first end of said fastening bolt; and said stopper being located a distance from said first end face of said sleeve greater than a length from said first end to said peripheral portion of said polygonal boss nearest said second end permitting said external threaded portion to be fully retracted within said sleeve hole.

2. A joint device according to claim 1, wherein said stopper is formed by one of a welded bead and a metallic piece bonded on the inner face of said sleeve hole.

3. A joint device for joining a node with a screw hole to a structural member having an anchor nut, the joint device comprising:

a fastening bolt having a first external threaded portion at a first end for engaging said screw hole of said node and a second external threaded portion at a second end for engaging said anchor nut in said structural member;

said first external threaded portion having a thread direction opposite that of said second external threaded portion;

said fastening bolt having a polygonal boss disposed between said first and second external threaded portions;

a sleeve having first and second end faces at opposite ends thereof for engaging said node and said structural member, respectively, and said sleeve defining a polygonal sleeve hole for slidably receiving said polygonal boss;

a third external threaded portion having a thread direction and pitch identical to those of said first external threaded portion, said third external threaded portion being formed between said polygonal boss and said second external threaded portion, and having a major diameter larger than that of said second external threaded portion and smaller than a diameter of an inscribed circle of said polygonal sleeve hole;

said fastening bolt slidably engaging said polygonal sleeve hole of said sleeve with said polygonal boss, said fastening bolt having an orientation with said first end nearest said first end face and said second end nearest said second end face;

an end cap having a first face for attachment at an end of said structural member, a second face opposite said first face for engaging said second end face of said sleeve, and said end cap defining a bore hole connecting said first and second faces of said end cap;

said bore hole having an internal threaded portion formed on an inner surface thereof and engaging said third external threaded portion of said fastening bolt;

a stopper protrusion, formed on an inner surface of said polygonal sleeve hole, having a height extending into said polygonal sleeve hole a distance sufficient to contact a peripheral portion of the polygonal boss nearest said second end of said fastening bolt and prevent sliding of said polygonal boss past said stopper protrusion while permitting sliding of said third external threaded portion through an entire length of the polygonal sleeve hole;

a first length, defined by a distance from the first end face of said sleeve to an end of said internal threaded portion nearest said sleeve when said second end face of said sleeve is in contact with said second face of said end cap, said first length being shorter than a difference between a second and a third length wherein:

said second length is defined by a distance from said first end of said fastening bolt to an end of said third external threaded portion nearest said second end of said fastening bolt; and said third length is defined by a distance sufficient for initial engagement of said first external threaded portion with the screw hole of said node; and a fourth length defined by a distance from the first end face of said sleeve to an end of said internal threaded portion nearest the first face of said end cap when said second end face of said sleeve abuts said second face of said end cap, said fourth length being longer than a sum of a fifth and a sixth length wherein:

said fifth length is defined as a distance from the first end face of said sleeve to said first end of said fastening bolt when said stopper protrusion contacts said peripheral portion of said polygonal boss nearest said second end; and said sixth length is defined as a distance from the first end of said fastening bolt to an end of the third external threaded portion nearest said first end of said fastening bolt.

4. A joint device according to claim 3, wherein a diameter of said bore hole outside said internal threaded portion in said end cap is is dimensioned to slidably guide said third external threaded portion such that axes of said fastening bolt and said bore hole are maintained substantially parallel.

5. A joint device according to claim 3, wherein a shank in said fastening bolt is disposed between said third external threaded portion and external diameters of said second external threaded portion and said shank are defined to enable slidable engagement of said shank with said internal threaded portion.

6. A joint device according to claim 3, wherein said internal threaded portion engages said third external threaded portion along an entire inner face of the bore hole in said end cap.

7. An apparatus for joining a structural member to a node having a threaded hole therein, said apparatus comprising:

a cap member for attachment to an end of said structural member, said cap member having a first side for accepting said structural member, a second side opposite said first side, and said cap member defining an aperture from said first side to said second, said aperture having an internal thread;

a sleeve member defining a multi-sided through hole and having a first face for engaging said node, a second face for engaging said cap member; and an outer surface configured to accept engagement with a tool for applying torque;

a bolt member having an a first external threaded portion at a first end for engaging said threaded hole of said node, a second end having anchor means for anchoring said bolt member in said cap member, and a multi-sided boss disposed between said first and second ends and slidably engaging said multi-sided through hole of said sleeve in a torque transmissive coupling;

said bolt member having a second external threaded portion engagable with said internal thread of said aperture and disposed between said multi-sided boss and said anchor means for extending and retracting said bolt member from and into said sleeve and said cap member by rotation of said bolt member via said sleeve;

said sleeve member having a length sufficient to accept a length of said bolt member from said first end through said multi-sided boss such that said bolt member can fully retract into said sleeve when said second external threaded portion sufficiently engages said internal thread and said second face of said sleeve abuts said cap member; and said second external threaded portion and said internal thread having lengths permitting disengagement thereof when said first external threaded portion is sufficiently extended from said sleeve to engage said threaded hole of said node,

8. The apparatus of claim 7 further comprising said sleeve having a retaining means for retaining said sleeve in slidable engagement with said multi-side boss to prevent disengagement of said sleeve and said bolt member when said bolt member is engaged with said cap member.

9. The apparatus of claim 8 wherein said retaining means is a protrusion on an inner surface of said multi-sided through hole having a height sufficient to interfere with slidable passage of said multi-sided boss through said sleeve.

10. The apparatus of claim 9 wherein:

said protrusion is disposed at a position on said sleeve between said multi-sided boss and said cap member when said second face of said sleeve abuts said cap member; and said sleeve has a length from said first face thereof to said protrusion sufficient for accepting said bolt member from said first end through said multi-sided boss.

11. The apparatus of claim 7 wherein said second external threaded portion has an external diameter less than an inner circumscribed diameter of said multi-sided boss and sufficiently small to permit slidable passage of said second external threaded portion through said multi-sided boss.

12. The apparatus of claim 11 wherein said aperture of said cap member has a smooth bore between said second side and said internal thread with a diameter sufficient in relation to said external diameter of said second threaded portion to guide said second external threaded portion into engagement with said internal thread when said bolt member is inserted into said cap member from said second side.

13. The apparatus of claim 7 wherein said first and second external threaded portions have identical thread direction and pitch.

14. The apparatus of claim 7 wherein said anchor means includes a third external threaded portion at said second end of said bolt member for accepting a nut, said third external threaded portion having an outside diameter less than an inside diameter of said internal thread of said cap member.

15. An apparatus for joining a structural member to a node having a threaded hole therein, said apparatus comprising:

a cap member for attachment to an end of said structural member, said cap member having a first side for accepting said structural member, a second side opposite said first side, and said cap member defining an aperture from said first side to said second, said aperture having an internal thread;

a sleeve member defining a multi-sided through hole and having a first face for engaging said node, a second face for engaging said cap member; and an outer surface configured to accept engagement with a tool for applying torque;

a bolt member having an a first external threaded portion at a first end for engaging said threaded hole of said node, a second end having anchor means for anchoring said bolt member in said cap member, and a multi-sided boss disposed between said first and second ends and slidably engaging said multi-sided through hole of said sleeve in a torque transmissive coupling;

said bolt member having a second external threaded portion engagable with said internal thread of said aperture having identical thread direction and pitch as said first external threaded portion and disposed between said multi-sided boss and said anchor means for extending and retracting said bolt member from and into said sleeve and said cap member by rotation of said bolt member via said sleeve;

said second external threaded portion having an external diameter less than an inner circumscribed diameter of said multi-sided boss and sufficiently small to permit slidable passage of said second external threaded portion through said multi-sided boss;

said sleeve member having a length sufficient to accept a length of said bolt member from said first end through said multi-sided boss such that said bolt member can fully retract into said sleeve when said second external threaded portion sufficiently engages said internal thread and said second face of said sleeve abuts said cap member;

said sleeve having a protrusion on an inner surface thereof for retaining said sleeve in slidable engagement with said multi-sided boss to prevent disengagement of said sleeve and said bolt member when said bolt member is engaged with said cap member, said protrusion having a height sufficient to interfere with slidable passage of said multi-sided boss through said sleeve; and said second external threaded portion and said internal thread having lengths permitting disengagement thereof when said first external threaded portion is sufficiently extended from said sleeve to engage said threaded hole of said node.

16. The apparatus of claim 15 wherein:

said protrusion is disposed at a position on said sleeve between said multi-sided boss and said cap member when said second face of said sleeve abuts said cap member; and said sleeve has a length from said first face thereof to said protrusion sufficient for accepting said bolt member from said first end through said multi-sided boss.

17. The apparatus of claim 15 wherein said aperture of said cap member has a smooth bore between said second side and said internal thread with a diameter sufficient in relation to said external diameter of said second external threaded portion to guide said second external threaded portion into engagement with said internal thread when said bolt member is inserted into said cap member from said second side.

18. The apparatus of claim 15 wherein said anchor means includes a third external threaded portion at said second end of said bolt member for accepting a nut, said third external threaded portion having an outside diameter less than an inside diameter of said internal thread of said cap member.

* * * * *